US011042122B2

(12) United States Patent
Iguchi

(10) Patent No.: US 11,042,122 B2
(45) Date of Patent: Jun. 22, 2021

(54) TIMEPIECE WITH ROTATABLE CROWN HAVING TACTILE FEEL

(71) Applicant: Seiko Instruments Inc., Chiba (JP)

(72) Inventor: Katsunobu Iguchi, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 219 days.

(21) Appl. No.: 16/291,881

(22) Filed: Mar. 4, 2019

(65) Prior Publication Data

US 2019/0278226 A1 Sep. 12, 2019

(30) Foreign Application Priority Data

Mar. 6, 2018 (JP) ..... JP2018-039913

(51) Int. Cl.
*G04B 3/04* (2006.01)

(52) U.S. Cl.
CPC ..... *G04B 3/041* (2013.01)

(58) Field of Classification Search
CPC ..... G04B 3/041; G04B 3/043; G04B 3/046; G04B 37/103; G04B 37/04; G04B 19/286; G04B 19/28; G04B 37/06
USPC ..... 368/308
See application file for complete search history.

(56) References Cited

U.S. PATENT DOCUMENTS

| | | | | |
|---|---|---|---|---|
| 7,909,503 | B2 * | 3/2011 | Hiranuma | G04B 37/106 368/308 |
| 8,371,745 | B2 * | 2/2013 | Manni | G04C 3/004 368/319 |
| 10,613,481 | B2 * | 4/2020 | Iguchi | G04B 3/046 |
| 2007/0076532 | A1 * | 4/2007 | Hiranuma | G04B 37/10 368/319 |
| 2016/0313701 | A1 * | 10/2016 | Coakley | G04B 3/046 |
| 2017/0315508 | A1 * | 11/2017 | Masone | G04B 3/043 |

FOREIGN PATENT DOCUMENTS

JP 2017-032286 A 2/2017

* cited by examiner

*Primary Examiner* — Edwin A. Leon
(74) *Attorney, Agent, or Firm* — Brinks Gilson & Lione

(57) ABSTRACT

A timepiece which provides a tactile feel in a simple structure and which can suppress inadvertent rotation of a driving crown is to be provided. A wristwatch includes an elastic material winding stem pipe protruding on the outer side of a case and a distal end portion of which is capable of elastic deformation in a radial direction; a shaft member of a driving crown rotatably inserted into the elastic material winding stem pipe; protrusions formed on the peripheral surface of the driving crown; and trough portions formed in the peripheral surface of the elastic material winding stem pipe and configured to be engaged with the protrusions.

9 Claims, 9 Drawing Sheets

TIMEPIECE WITH ROTATABLE CROWN HAVING TACTILE FEEL

RELATED APPLICATIONS

This application claims priority under 35 U.S.C. § 119 to Japanese Patent Application No. 2018-039913 filed on Mar. 6, 2018, the entire content of which is hereby incorporated by reference.

BACKGROUND OF THE INVENTION

1. Field of the Invention

The present disclosure relates to the structure of a timepiece.

2. Description of the Related Art

For example, in a conventional common timepiece equipped with an in-revolving ring, it is possible to hold an in-revolving cogwheel installed on the shaft of a driving crown and a cogwheel formed on the in-revolving ring in mesh with each other, and to freely determine the rotational position of the in-revolving ring through rotation of the driving crown. No operational "feel," however, is experienced when rotating the driving crown. That is, the rotational position of the driving crown, i.e., the rotational position of the in-revolving ring, is maintained solely by the resistance of a packing in the driving crown and the friction between the components. When rotating the driving crown, the fingers substantially feel free. In other words, they only receive a fixed resistance.

A prior art document (e.g., JP-A-2017-32286 (Patent Document 1)) discloses a timepiece provided with a rotation operating device in which a movable cogwheel having protrusions and recesses is slidably mounted to the shaft of a driving crown and which is equipped with a stationary cogwheel having protrusions and recesses in correspondence with the movable cogwheel on a cylinder installed in a case and a spring member pressing the protrusions and recesses of the movable cogwheel against the protrusions and recesses of the stationary cogwheel. Due to this structure, in the timepiece of the prior art document, it is possible to experience a tactile feel when rotating the driving crown.

In the rotation operating device of the prior art document, however, it is necessary to provide the spring member for pressing the protrusions and recesses of the movable cogwheel against the protrusions and recesses of the stationary cogwheel, resulting in an increase in the number of components and in cost compared with the conventional common timepiece. Thus, it leaves room for an improvement.

Further, in the rotation operating device of the prior art document, there exists, between an insertion hole of the movable cogwheel and the shaft portion of the driving crown inserted into this insertion hole, a gap for causing the shaft portion to slide. Thus, even when the movable cogwheel is at rest, the driving crown undergoes a minute rotation in the rotational direction. In other words, the driving crown rattles in the rotational direction. Thus, it leaves room for an improvement.

SUMMARY OF THE INVENTION

Each of embodiments of the present invention has been made in view of the above problems. Each of embodiments provides a timepiece which provides a tactile feel in a simple structure and which can suppress inadvertent rotation of a crown.

According to a first aspect, there is provided a timepiece including a tube member which protrudes on an outer side of a case and a distal end portion of which is capable of elastic deformation in a radial direction; a crown rotatably inserted into the tube member; protrusions and recesses formed on a peripheral surface of one of the tube member and the crown; and an engagement portion that is formed on a peripheral surface of the other of the tube member and the crown and that is engaged with the protrusions and recesses.

According to a second aspect, there is provided a timepiece according to the first aspect, wherein a portion of the tube member capable of elastic deformation is formed by a divisional member obtained through peripheral division by a plurality of grooves extending from a distal end side toward a proximal end side of the tube member and formed at peripheral intervals.

According to a third aspect, there is provided a timepiece according to the second aspect, wherein the divisional member has on the proximal end side a thin-walled portion thinner than on the distal end side.

According to a fourth aspect of the present invention, there is provided a timepiece according to any of the first to third aspects, wherein the crown is equipped with a shaft member and a cap-like head portion which is connected to a distal end of the shaft member and the case side of which is open; a protrusion as the engagement portion is formed on an inner peripheral portion of the head portion; and the protrusions and recesses is formed on an outer peripheral portion of the tube member.

According to a fifth aspect of the present invention, there is provided a timepiece according to any of the first to third aspects, wherein the crown is equipped with a shaft member and a cap-like head portion which is connected to a distal end of the shaft member and the case side of which is open; the protrusions and recesses is formed on an outer peripheral portion of the shaft member; and the engagement portion is formed on an inner peripheral portion of the tube member.

DETAILED DESCRIPTION OF THE PREFERRED EMBODIMENTS

First Embodiment

The first embodiment of the present invention will be described with reference to FIGS. 1 through 6.

Figure 1:
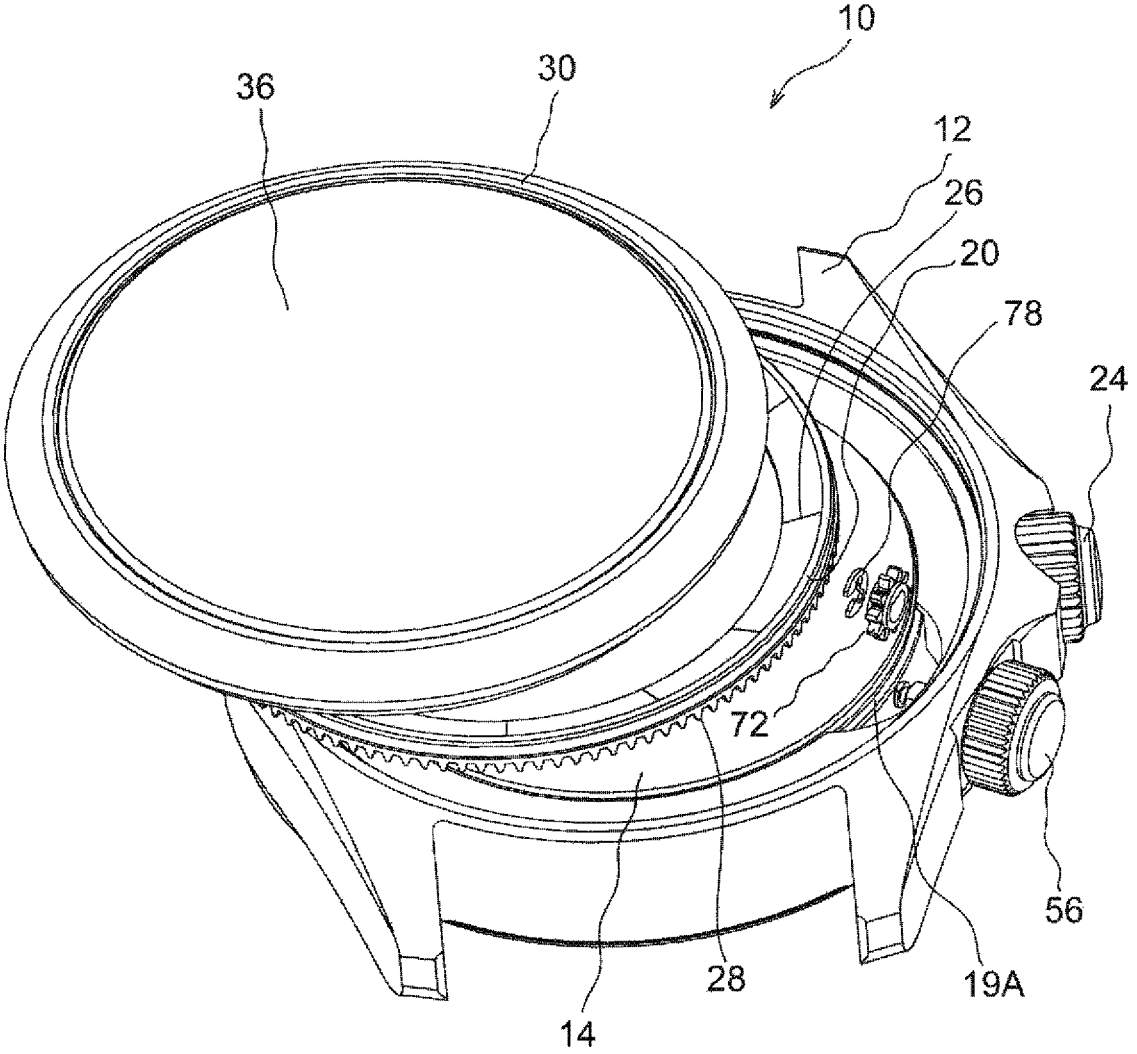
FIG. 1 is an exploded perspective view of a wristwatch according to a first embodiment of the present invention.
Figure 2:
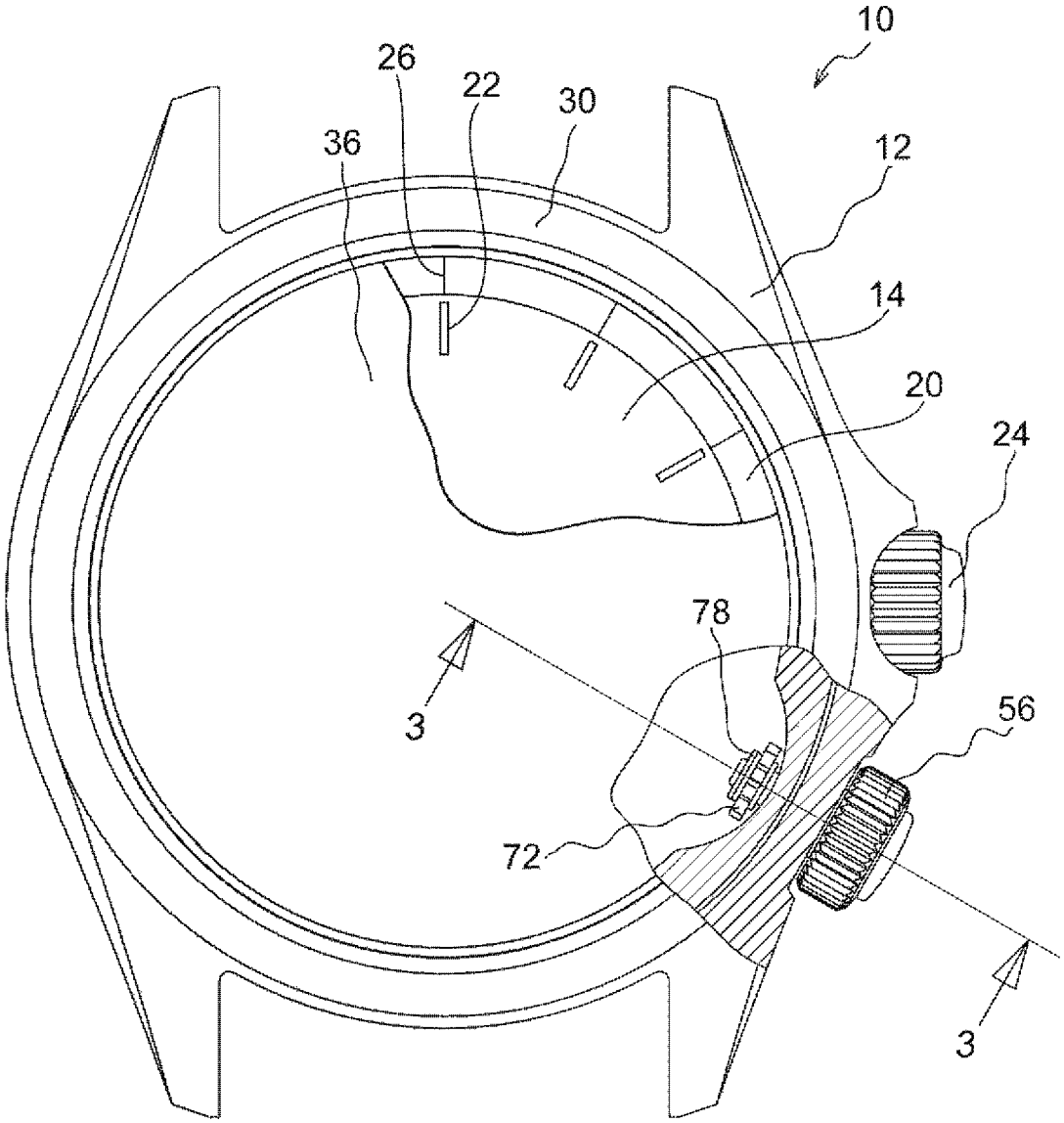
FIG. 2 is a front view, partly in section, of the wristwatch according to the first embodiment.

As shown in FIGS. 1 and 2, a wristwatch 10 is equipped with a case 12 constituting an outer jacket. The belt of the wristwatch 10 is omitted in the drawing.

Figure 3:
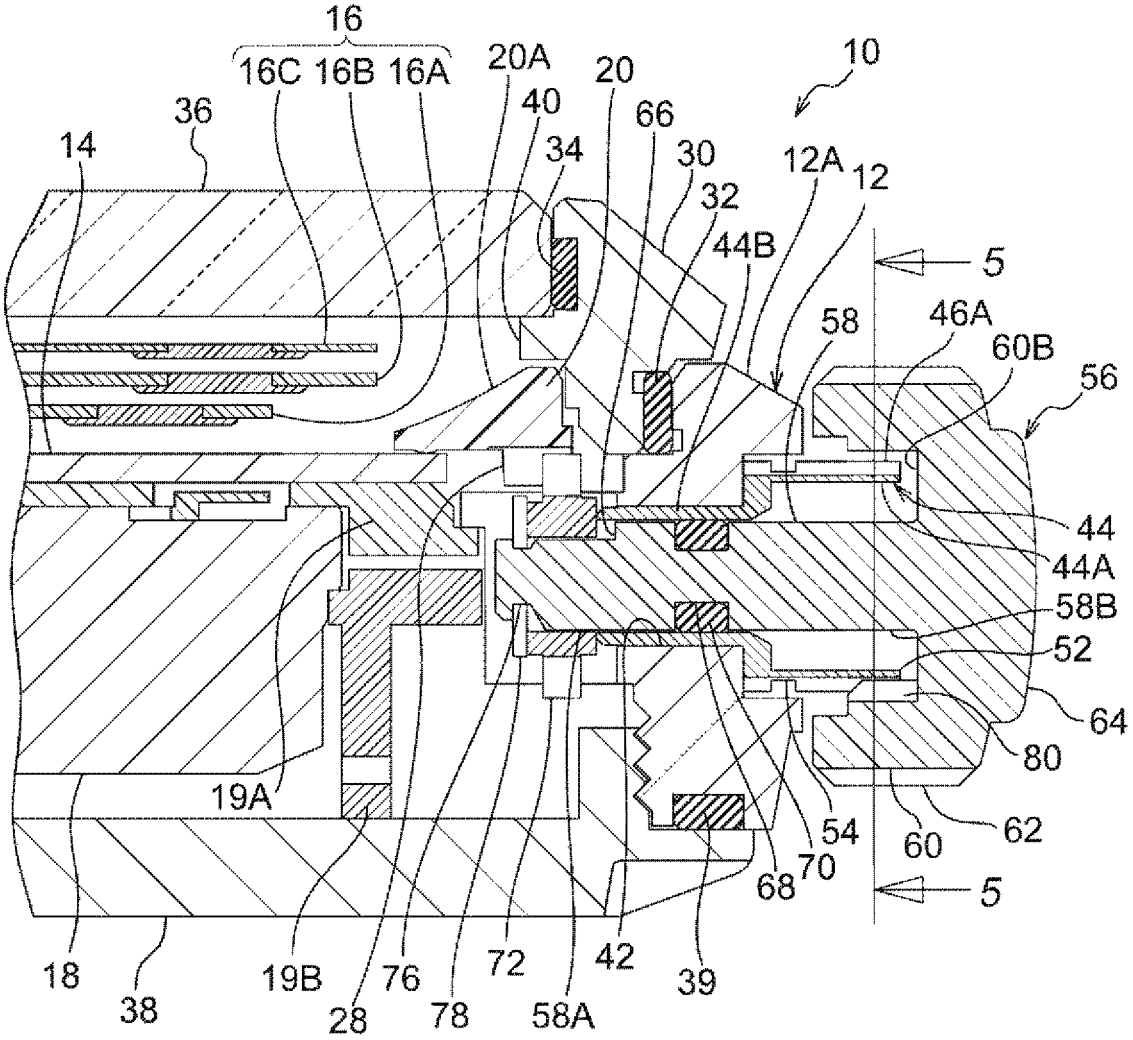
FIG. 3 is a sectional view taken along line 3-3 of the wristwatch shown in FIG. 2.

As shown in FIGS. 2 and 3, accommodated in the case 12 are mechanisms such as a dial 14, a movement 18 controlling the movement of time indicator hands 16 indicating time, and a rotated member, for example, an in-revolving ring 20. The movement 18 is accommodated in the case 12 along with a movement retaining ring 19A and a middle frame 19B. The rotated member is not restricted to the in-revolving ring 20 described below. It is only necessary for the rotated member to be one that is rotatably accommodated in the case 12 and that is rotated in conjunction with an operation performed from the outside of the case 12.

As shown in FIG. 2, the dial 14 is circular and has in the peripheral portion a time-indicating scale 22. As shown in FIG. 3, the time indicator hands 16 of the present embodiment include an hour hand 16A, a minute hand 16B, and a second hand 16C.

As shown in FIG. 2, in the 3 o'clock direction of the wristwatch 10, a time correction crown 24 is mounted so as to be rotatable with respect to the case 12. The time correction crown 24 is rotated outside the case 12. The rotation of the time correction crown 24 is imparted to a train wheel (not shown) of the movement 18 in order to rotate, for example, the minute hand 16B, adjusting the position of the minute hand 16B.

The in-revolving ring 20 is rotatably arranged on the front surface side of the peripheral portion of the dial 14. The in-revolving ring 20 is formed, for example, of synthetic resin, and is of a ring-like configuration in plan view as shown in FIG. 2. As shown in FIG. 3, the outer diameter of the in-revolving ring 20 is larger than the diameter (outer diameter) of the dial 14, and the inner diameter of the in-revolving ring 20 is smaller than the diameter of the dial 14.

As shown in FIG. 3, the thickness of the in-revolving ring 20 increases gradually from the inner periphery toward the outer periphery. The oblique and annular surface of the in-revolving ring 20 thus formed serves as a display surface 20A, and a display 26 is provided on the display surface 20A as shown in FIG. 1. The display 26 is, for example, a scale provided by printing or the like at equal intervals along the peripheral direction of the in-revolving ring 20. For example, it is possible to attain a timer function by which a period of time elapsing from a predetermined point in time is measured through a change in the relative position of the display 26 moved to a predetermined position through the rotation of the in-revolving ring 20 and the time indicator hands 16.

The display 26 of the in-revolving ring 20 is not restricted to a scale but may be a plurality of display regions divided by colors different from each other. Alternatively, the display 26 may consist of symbols respectively depicted in a plurality of plain display regions (e.g., a sun symbol representing daytime and a moon symbol representing the time after sunset). Further, instead of functioning as a timer, the display 26 may be a directional display (N, W, S, E, etc.) allowing simple directional measurement.

While, as described above, it is necessary for the in-revolving ring 20 to be of a ring-like configuration in plan view, this should not be construed restrictively. In the case where the in-revolving ring 20 is of a ring-like configuration in plan view, it may be of an endless configuration in plan view or it may have ends that are opposite each other to form a C-shaped configuration in plan view.

As shown in FIGS. 1 and 3, on the back surface side of the in-revolving ring 20, there is provided a moved cogwheel portion 28 in the vicinity of the outer peripheral edge. The moved cogwheel portion 28 is a so-called crown wheel. It has a plurality of teeth extending in the radial direction of the in-revolving ring 20 and formed at equal peripheral intervals. The moved cogwheel portion 28 is situated on the outer side in the radial direction of the outer peripheral edge of the dial 14.

As shown in FIG. 3, in the case 12, an annular glass edge 30 is attached to the front surface side in the thickness direction of an annularly formed case band 12A in a liquid-tight fashion through the intermediation of an annular glass edge fixation packing 32. A circular glass 36 as a transparent cover is attached to the inner peripheral side of the glass edge 30 in a liquid-tight fashion through the intermediation of an annular glass fixation packing 34. Through this glass 36, the dial 14, the time indicator hands 16, and the in-revolving ring 20 are visible.

Further, in the case 12, a case back 38 is attached to the back surface side in the thickness direction of the case band 12A in a liquid-tight fashion through the intermediation of an annular packing 39. The case back 38 of the present embodiment is a so-called screw back. While it is desirable for the case 12 to be formed of a metal such as stainless steel or titanium, it may also be formed of synthetic resin, ceramics or the like.

On the inner peripheral portion of the glass edge 30, there is formed an annular protrusion 40 protruding toward the inner side in the radial direction. The outer peripheral surface of the glass 36 is in contact with the inner peripheral portion of the glass edge 30 on the timepiece surface side of the annular protrusion 40, and the back surface of the peripheral portion thereof is in contact with the annular protrusion 40 to be supported by the glass edge 30.

This annular protrusion 40 covers the outer peripheral portion of the in-revolving ring 20 from the timepiece front surface side. As a result, the in-revolving ring 20 is supported so as to be rotatable with respect to the dial 14 and the annular protrusion 40 and so as to be immovable in the thickness direction of the wristwatch 10. Further, the inner peripheral surface of the glass edge 30 situated on the back side of the annular protrusion 40 is close to the outer peripheral surface of the in-revolving ring 20, whereby the in-revolving ring 20 is supported by the glass edge 30 so as to be immovable in the radial direction.

(Click Mechanism)

Figure 4:
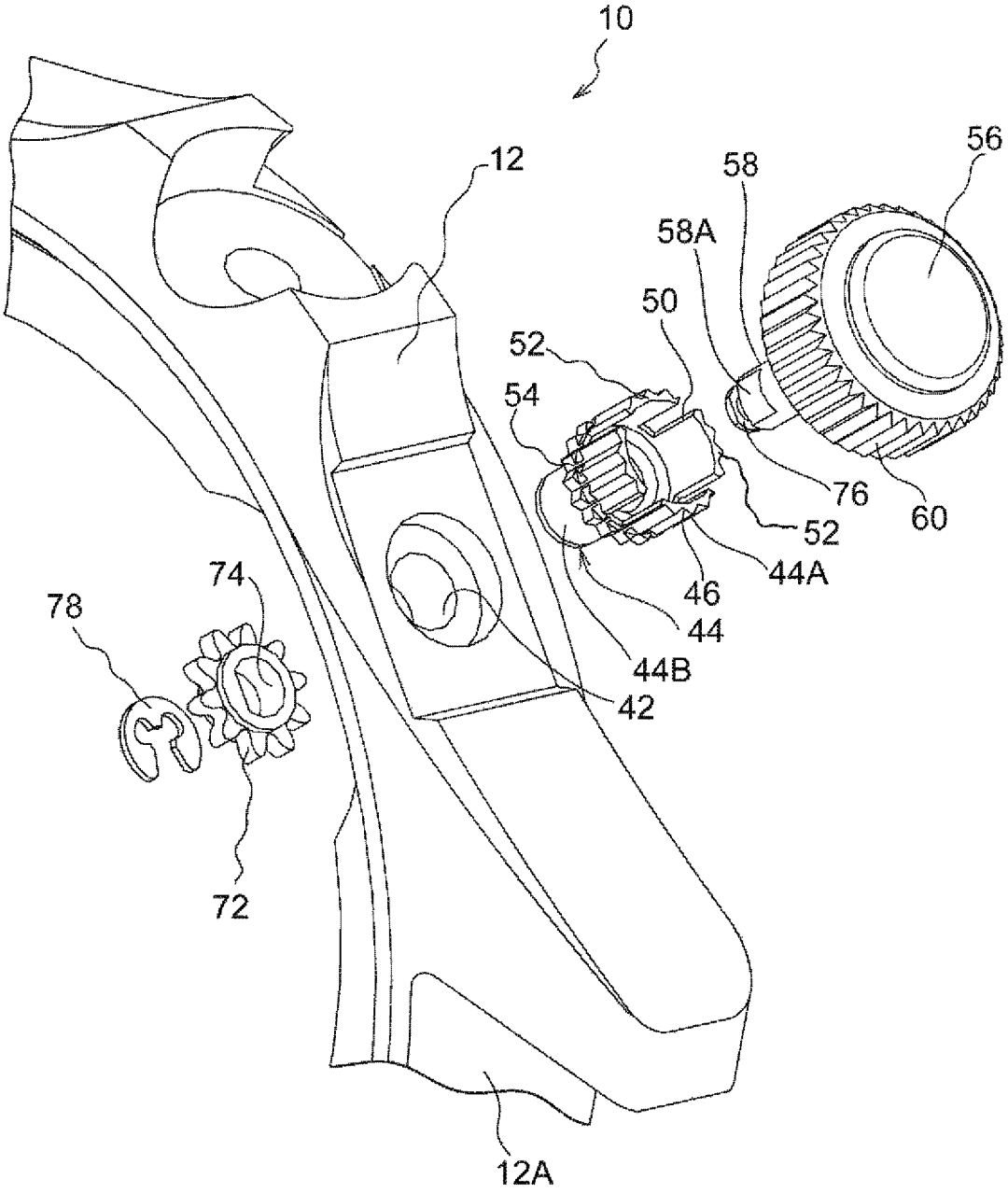
FIG. 4 is an exploded perspective view of a driving crown and peripheral components of the wristwatch according to the first embodiment.

As shown in FIGS. 3 and 4, the case band 12A has, at a position deviated from the mounting position of the time correction crown 24, and, in the present embodiment, in the 4 o'clock direction (See FIG. 2), a through-hole 42 extending through in the radial direction. An elastic material winding stem pipe 44 is inserted into this through-hole 42.

The elastic material winding stem pipe 44 is formed in a stepped cylindrical configuration having a large diameter portion 44A and a small diameter portion 44B, with the small diameter portion 44B being inserted into the through-hole 42 for fixation by adhesive or the like. The large diameter portion 44A of the elastic material winding stem pipe 44 is arranged outside the case 12, with the end surface on the small diameter portion 44B side thereof being in contact with the outer surface of the case 12. The end portion of the small diameter portion 44B on the side opposite the large diameter portion 44A protrudes to the inner side of the case 12.

Figure 5:
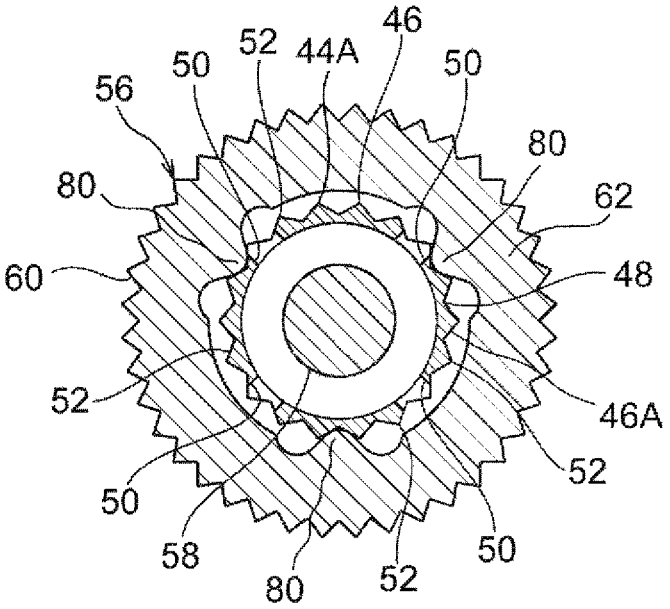
FIG. 5 is a sectional view taken along line 5-5 of the wristwatch shown in FIG. 3.

As shown in FIGS. 4 and 5, a grain knurl 46 is formed on the outer peripheral surface of the large diameter portion 44A. On the grain knurl 46, there are arranged at equal peripheral intervals V-shaped (triangular in the present embodiment) teeth 46A extending along the axial direction. In the present embodiment, 18 teeth 46A are formed on the outer peripheral surface of the large diameter portion 44A. It is desirable for the teeth 46A to be of a tapered configuration. The configuration is not restricted to a triangular one. For example, the distal end of the triangle may be rounded. It may also be an isosceles trapezoid or the like. In the present specification, the recessed portions between the teeth 46A are referred to as trough portions 48. The teeth 46A and the trough portions 48 of the present embodiment are an example of the protrusions and recesses of the present invention.

As shown in FIGS. 4 and 5, the large diameter portion 44A has four expanding slots 50 extending in the axial direction and formed at a peripheral interval of 90 degrees. The expanding slots 50 are formed from the end portion of the large diameter portion 44A on the side opposite the small diameter portion 44B to the vicinity of the stepped portion. That is, the slot bottoms of the expanding slots 50 are situated in the vicinity of the stepped portion.

As shown in FIG. 5, in the large diameter portion 44A, the portions between the expanding slots 50 are formed as elastically deformable members 52 of an arcuate configuration as seen from the axial direction.

As shown in FIGS. 3 and 4, the outer peripheral surface of the large diameter portion 44A has an annular groove 54 on the outer side of the slot bottoms of the expanding slots 50, thus reducing the thickness of the proximal portion of the elastically deformable member 52. This portion in which the thickness of the elastically deformable member 52 is reduced is an example of the thin-walled portion of the present invention. As a result, the elastically deformable member 52 is capable of elastic deformation so as to be inclined in the radially inner-outer direction using the annular groove 54 as a fulcrum. The elastic material winding stem pipe 44 of the present embodiment can be formed, for example, through the cutting of a metal material such as stainless steel.

Figure 6:
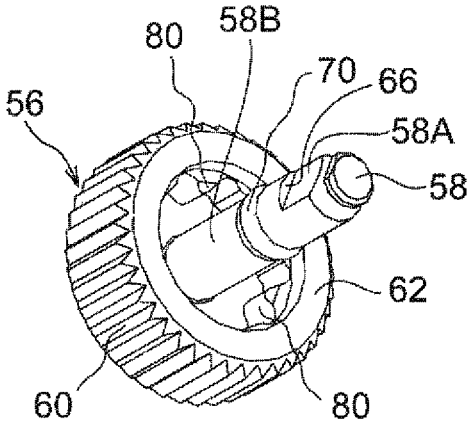
FIG. 6 is a perspective view of the driving crown of the wristwatch according to the first embodiment.

As shown in FIGS. 3 and 6, a shaft member 58 integrally connected to a driving crown 56 is inserted into the small diameter portion 44B of the elastic material winding stem pipe 44. The driving crown 56 is used to rotate the in-revolving ring 20. When the driving crown 56 is rotated outside the case 12, the in-revolving ring 20 rotates in conjunction therewith. The driving crown 56 and the shaft member 58 are an example of the crown of the present invention, and the driving crown 56 is an example of the head portion of the present invention.

The driving crown 56 as the head portion is formed in a cap-like configuration having a ring-like peripheral wall 62 and an end wall 64 closing one end of this peripheral wall 62. The outer peripheral surface of the peripheral wall 62 has a grain knurl 60 for preventing slipping of the fingers of the operator rotating this driving crown 56.

The sectional configuration of the shaft member 58 orthogonal to the axis is circular except for a portion at the distal end side. Its total length is larger than the total length of the elastic material winding stem pipe 44. A part of the outer peripheral portion at the distal end side of the shaft member 58 is machined to be flat to form a step 66. The portion of the shaft member 58 machined to be flat is of a D-shaped sectional configuration orthogonal to the axis. Hereinafter, in the present specification, the portion of the shaft member 58 the sectional configuration of which is D-shaped is referred to as an irregular shaped section shaft member 58A.

In the shaft member 58, the diameter of the outer peripheral surface of the portion from the driving crown 56 side root to the step 66 is fixed, and is slightly smaller than the inner diameter of the small diameter portion 44B of the elastic material winding stem pipe 44. Hereinafter, in the shaft member 58, the portion the diameter of which is fixed will be referred to as a fixed diameter shaft member 58B. This fixed diameter shaft member 58B is rotatable while inserted into the hole of the small diameter portion 44B of the elastic material winding stem pipe 44.

The fixed diameter shaft member 58B of the shaft member 58 has, at the intermediate portion in the longitudinal direction thereof, an annular mounting groove 68 continuous in the peripheral direction. Accommodated in this mounting groove 68 is a ring-like packing 70 sealing the gap between the elastic material winding stem pipe 44 and the shaft member 58.

As shown in FIG. 3, a driving wheel 72 transmitting the rotation of the driving crown 56 to the in-revolving ring 20 is mounted to the irregular shaped section shaft member 58A of the shaft member 58. As shown in FIG. 4, the driving wheel 72 has a fit-engagement hole 74 having a configuration corresponding to the sectional configuration of the irregular shaped section shaft member 58A, and the irregular shaped section shaft member 58A of the shaft member 58 is fit-engaged with this fit-engagement hole 74. At the distal end side of the irregular shaped section shaft member 58A, there is formed an annular groove 76 that is peripherally continuous, and by mounting a retaining ring 78 to this groove 76, the driving wheel 72 is mounted in a state in which it is prevented from rotating at the irregular shaped section shaft member 58A between the retaining ring 78 and the step 66.

As a result, the driving wheel 72 is constantly in mesh with the moved cogwheel portion 28 of the in-revolving ring 20.

As shown in FIGS. 5 and 6, on the inner peripheral surface of the peripheral wall 62 of the driving crown 56, there are formed, at equal peripheral intervals, three protrusions 80 protruding toward the inner side in the radial direction. As shown in FIG. 5, the protrusions 80 are formed in a chevron-shaped configuration the apex portion of which is arcuate as seen from the axial direction of the driving crown 56. The protrusions 80 are an example of the protrusion as the engagement portion of the present invention.

As shown in FIGS. 3 and 5, the large diameter portion 44A of the elastic material winding stem pipe 44 is inserted into the annular space portion between the peripheral wall 62 of the driving crown 56 and the shaft member 58.

As shown in FIG. 5, normally, each of the protrusions 80 of the driving crown 56 enters the trough portions 48 between the teeth 46A of the elastic material winding stem pipe 44 to be contact with the inclined surface of one tooth 46A and the inclined surface of the other tooth 46A. In other words, each protrusion 80 of the driving crown 56 is retained while held between two teeth 46A.

(Operation and Effect)

In the following, the operation and effect of the wristwatch 10 will be described.

Normally (when the driving crown 56 is not being operated), the protrusion 80 of the driving crown 56 enters the trough portion 48 between the teeth 46A of the elastic material winding stem pipe 44 as shown in FIG. 5, and the protrusion 80 is kept retained while held between the two teeth 46A, so that when, for example, the driving crown 56 comes into contact with some object, it is possible to suppress inadvertent rotation of the driving crown 56. In other words, to rotate the driving crown 56, it is necessary to deform the elastically deformable member 52 (as described in detail below), and, to rotate the driving crown 56, a certain degree of torque (e.g., an intentional torque with which the operator tries to rotate the driving crown 56) is necessary, so that it is possible to suppress rotation of the driving crown 56 by the degree of force exerted by the driving crown 56 coming into contact with some object.

In the wristwatch 10 of the present embodiment, although the driving wheel 72 is constantly in mesh with the moved cogwheel portion 28 of the in-revolving ring 20, it is possible to suppress inadvertent rotation of the in-revolving ring 20 and idling of the driving crown 56 when, for example, the wristwatch is being carried about.

In this way, inadvertent rotation of the driving crown 56 is suppressed, and malfunction of the in-revolving ring 20 is suppressed, so that it is possible to suppress inadvertent disorder of the function (e.g., timer function) determined by the relationship between the display 26 of the in-revolving ring 20 and the time display scale 22 of the dial 14 or the time indicator hands 16.

Here, when the in-revolving ring 20 is to be rotated, the operator pinches the driving crown 56 with fingers to rotate the driving crown 56. When the driving crown 56 is rotated, the driving wheel 72 mounted to the driving crown 56 rotates the moved cogwheel portion 28 of the in-revolving ring 20, rotating the in-revolving ring 20 provided with the moved cogwheel portion 28.

When the driving crown 56 is rotated, the protrusions 80 formed on the inner peripheral surface of the driving crown 56 press the side surfaces of the teeth 46A of the elastic material winding stem pipe 44, and the elastically deformable member 52 undergoes elastic deformation so as to be inclined inwards in the radial direction. Further, when the rotation of the driving crown 56 is continued, each protrusion 80 gets over the apex portion of the tooth 46A to escape from the trough portion 48, and enters the next trough portion 48 between the tooth 46A gotten over and the other tooth 46A adjacent to the tooth 46A gotten over. When the protrusion 80 enters the next trough portion 48, the elastically deformable member 52 elastically deformed toward the inner side in the radial direction is elastically restored to the former position.

In this way, the driving crown 56 is rotated, and each protrusion 80 gets over the apex portion of the tooth 46A and enters the next trough portion 48, whereby a tactile feel is provided, and the operator can perceptibly determine that the driving crown 56 is rotating.

As described above, a click structure for providing a tactile feel can be formed by the two components of the driving crown 56 and the elastic material winding stem pipe 44, so that it is possible to realize the click mechanism in a simple structure.

Further, each protrusion 80 of the driving crown 56 enters the trough portion 48 between the teeth 46A of the elastic material winding stem pipe 44, and the protrusion 80 is retained while held in contact with two teeth 46A, so that it is also possible to suppress rattling in the rotational direction of the driving crown 56.

Further, the click mechanism can be assembled by the following simple operation. After the elastic material winding stem pipe 44 is inserted into the through-hole 42, the shaft member 58 of the driving crown 56 is inserted into the elastic material winding stem pipe 44, and then the driving wheel 72 is fixed to the distal end side of the shaft member 58 by the retaining ring 78. In the present embodiment, when the shaft member 58 is inserted, there is involved no repulsion due to a spring as in Patent Document 1, so that the incorporating operation is facilitated.

While in the wristwatch 10 of the present embodiment the grain knurl 46 formed on the elastic material winding stem pipe 44 has 18 teeth 46A, the number of teeth 46A of the grain knurl may be less than 18 or more than 18.

In the wristwatch 10 of the present embodiment, 18 trough portions 48 are formed in the outer peripheral portion of the elastic material winding stem pipe 44, so that when the driving crown 56 makes one rotation, a tactile feel can be experienced 18 times (i.e., each time the protrusion 80 gets over one tooth 46A, a tactile feel is experienced once).

When the number of teeth of the driving wheel 72, the number of teeth of the moved cogwheel portion 28, and the number of clicks per rotation of the driving crown 56 are adjusted, and the operator grasps the correspondence relationship between the number of clicks of the driving crown 56 and the rotational angle of the in-revolving ring 20, the operator can rotate the in-revolving ring 20 by a predetermined rotational angle without visually checking the in-revolving ring 20 by counting the number of clicks when the driving crown 56 is rotated.

For example, in the case of an in-revolving ring 20 designed to grasp time, it is possible to cause the number of clicks of the driving crown 56 to correspond to the rotational angle of the in-revolving ring 20 (the time as indicated by the display 26), and, in the case of an in-revolving ring 20 designed to grasp direction, it is possible to cause the number of clicks of the driving crown 56 to correspond to the rotational angle (directional angle) of the in-revolving ring 20.

Normally (when the driving crown 56 is not being operated), it is only necessary for at least the protrusion 80 of the driving crown 56 to be retained while held in contact with two teeth 46A of the elastic material winding stem pipe 44. At this time, the elastically deformable member 52 may not be deformed, or may be somewhat deformed inwards in the radial direction by being pressed by the protrusion 80. By placing the elastically deformable member 52 in a state in which it is somewhat deformed inwardly in the radial direction by being pressed by the protrusion 80, it is possible to enhance the requisite torque for rotating the driving crown 56, making it possible to further suppress inadvertent rotation of the driving crown 56.

Second Embodiment

The wristwatch 10 according to the second embodiment of the present invention will be described with reference to FIGS. 7 through 10. The components that are the same as those of the first embodiment are indicated by the same reference numerals, and a description thereof will be left out.

Figure 7:
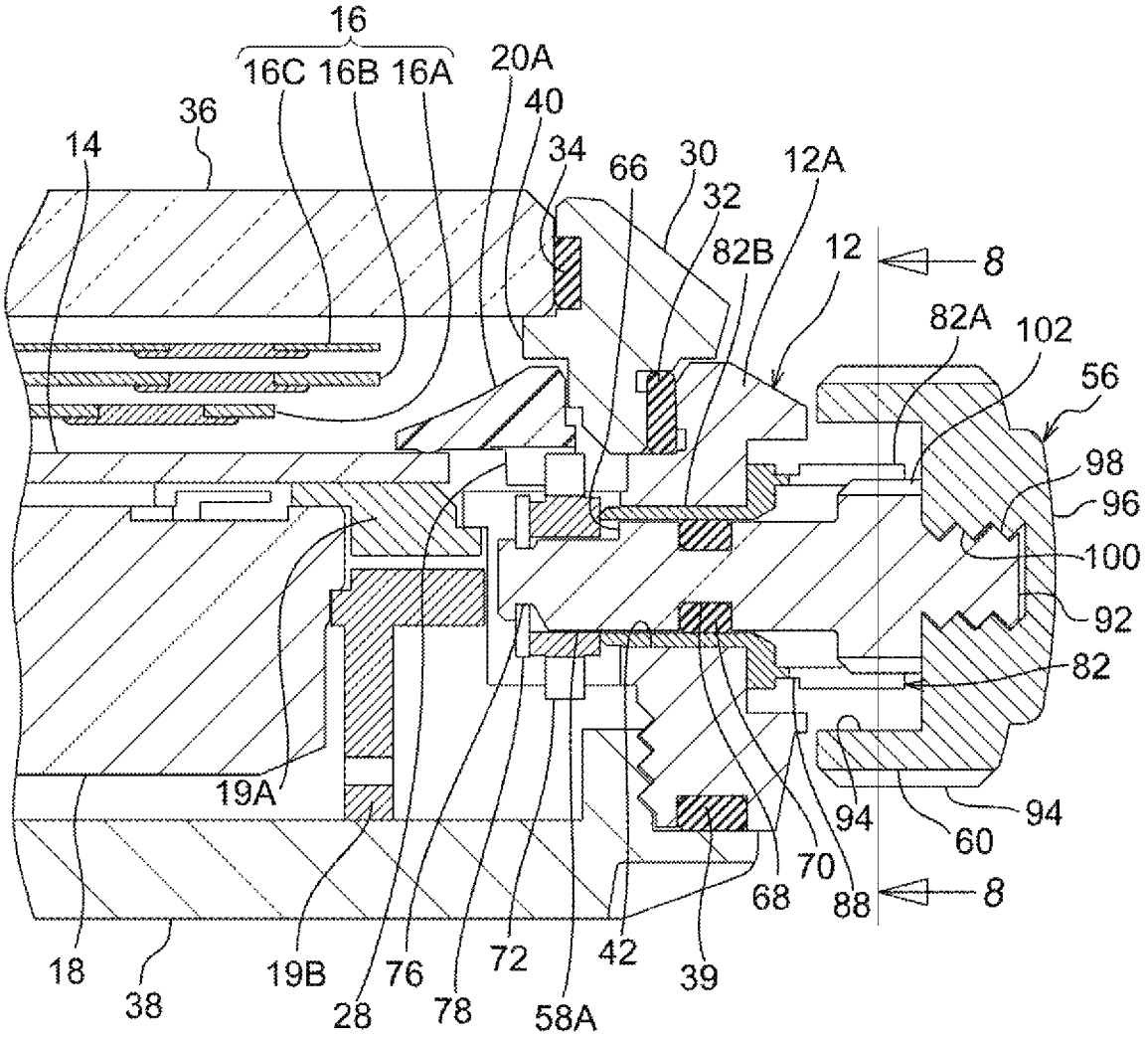
FIG. 7 is a sectional view of a main portion of a wristwatch according to a second embodiment of the present invention.
Figure 8:
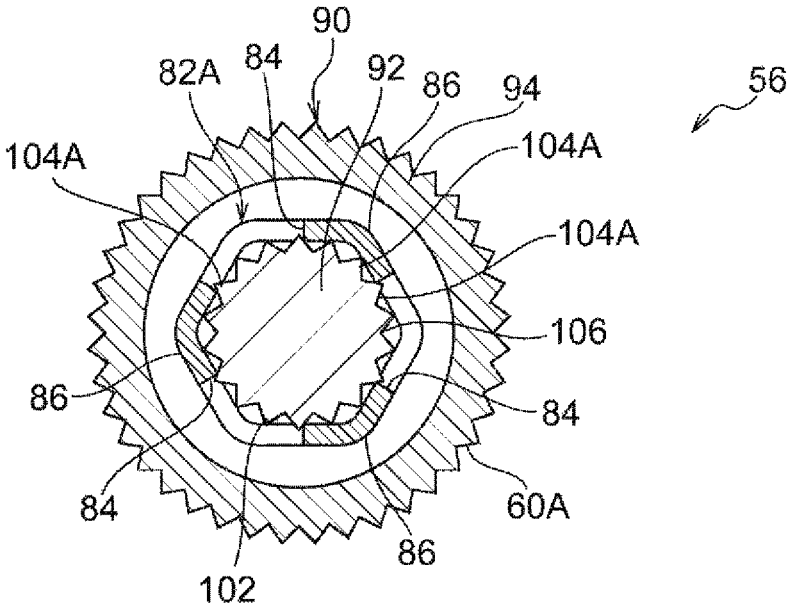
FIG. 8 is a sectional view taken along line 8-8 of the wristwatch shown in FIG. 7.
Figure 9:
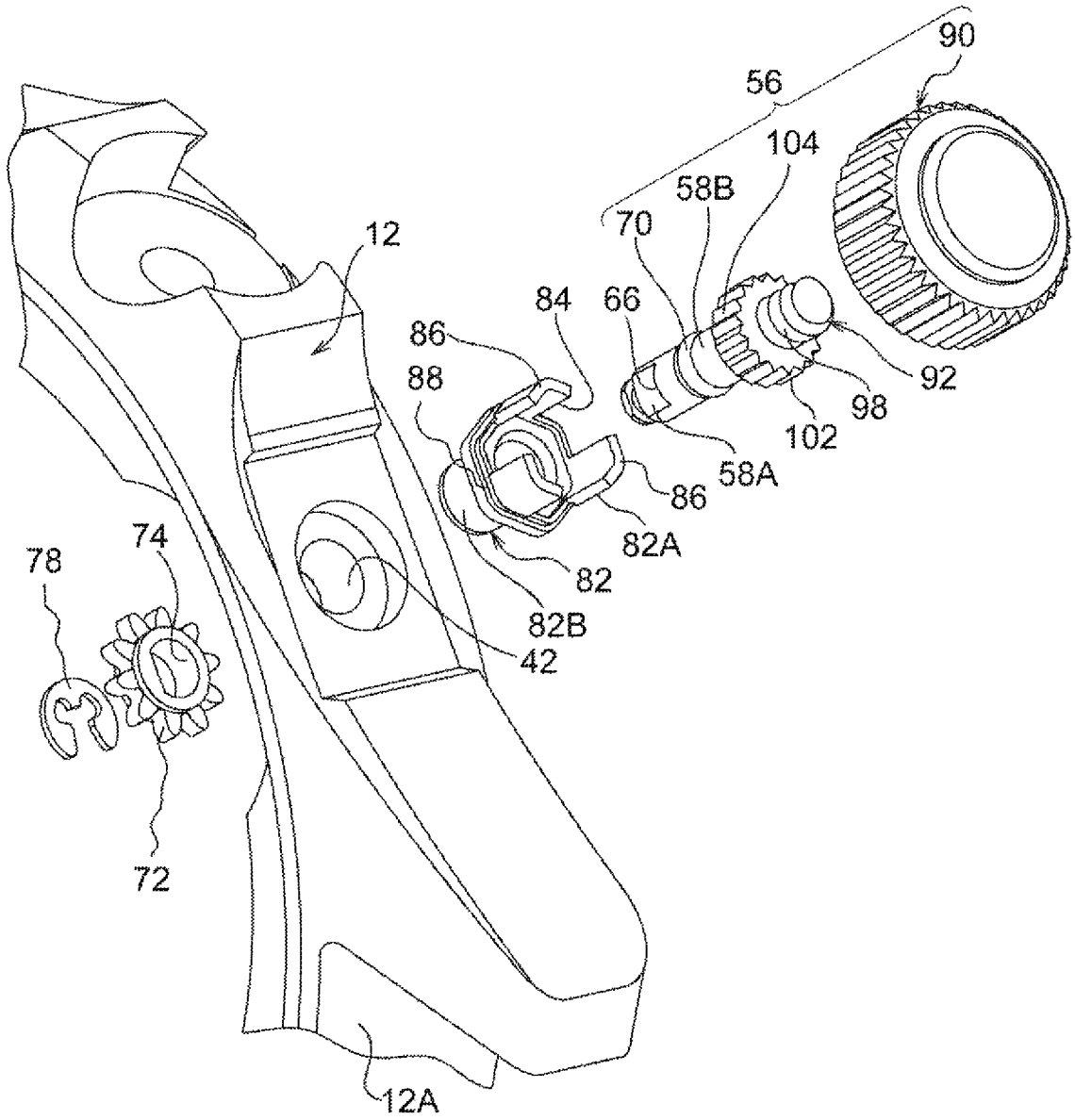
FIG. 9 is an exploded perspective view of a driving crown and peripheral components of the wristwatch according to the second embodiment.

As shown in FIG. 7, in the wristwatch 10 of the present embodiment, an elastic material winding stem pipe 82 of a configuration different from that of the first embodiment is inserted into the through-hole 42 of the case 12. As shown in FIGS. 7 through 9, the elastic material winding stem pipe 82 of the present embodiment is equipped, on one side of a small diameter portion 82B formed as a cylinder, with a large diameter portion 82A formed as a tube of a hexagonal sectional configuration. The large diameter portion 82A has, at every other one of six corner portions, expanding slots 84 extending in the axial direction. The expanding slots 84 are formed to extend from the end portion of the large diameter portion 82A on the side opposite the small diameter portion 82B to the vicinity of the stepped portion. That is, the slot bottoms of the expanding slots 84 are situated in the vicinity of the stepped portion.

As shown in FIG. 8, in the large diameter portion 82A, the portion between the expanding slots 84 is formed as an elastically deformable member 86 bent into a chevron shape as seen from the axial direction. The inner peripheral portion of the elastically deformable member 86, which is protruded and recessed in the peripheral direction, is an example of the engagement portion of the present invention.

As shown in FIG. 7, the outer peripheral surface of the large diameter portion 82A has an annular groove 88 on the outer side of the slot bottoms of the expanding slots 84, reducing the thickness of the proximal portion of the elastically deformable member 86. The portion of the elastically deformable member 86 reduced in thickness is an example of the thin-walled portion of the present invention. Due to this structure, the elastically deformable member 86 is capable of elastic deformation so as to be inclined in the inner-outer direction in the radial direction using the annular groove 88 as a fulcrum.

As shown in FIGS. 7 and 9, the driving crown 56 and a shaft member 92 of the present embodiment are formed as separate members. The driving crown 56 and the shaft member 92 are an example of the crown of the present invention.

Figure 10:
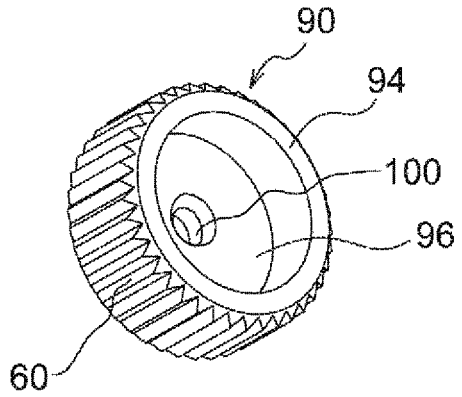
FIG. 10 is a perspective view of a head portion of the driving crown of the wristwatch according to the second embodiment.

As shown in FIG. 10, the driving crown 56 of the present embodiment is formed in a cap-like configuration having a ring-like peripheral wall 94 and an end wall 96 closing one end of this peripheral wall 94. The grain knurl 60 is formed on the outer peripheral surface of the peripheral wall 94. The inner peripheral surface of the peripheral wall 94 of the present embodiment is formed in a fixed diameter. At the center of the end wall 96, there is formed a female screw 100 with which a male screw 98 of the shaft member 92 described below is threadedly engaged.

As shown in FIGS. 7 and 9, like the shaft member 58 of the first embodiment described above, the shaft member 92 of the present embodiment is equipped with the fixed diameter shaft member 58B, the step 66, and the irregular shaped section shaft member 58A. However, on the side of the fixed diameter shaft member 58B opposite the irregular shaped section shaft member 58A, it is equipped with a large diameter shaft portion 102 formed in a larger diameter than the fixed diameter shaft member 58B and the male screw 98.

As shown in FIGS. 8 and 9, a grain knurl 104 is formed on the outer peripheral surface of the large diameter shaft portion 102. The grain knurl 104 has axially extending chevron-shaped (triangular in the present embodiment) teeth 104A arranged at equal peripheral intervals. In the present embodiment, 18 teeth 104A are formed on the outer peripheral surface of the large diameter portion 82A. The teeth 104A, which are preferably of a tapered configuration, are not restricted to a triangular configuration. For example, the distal ends of the triangles may be rounded, or the teeth may be of an isosceles trapezoidal configuration or the like. Here, the recessed portions between the teeth 104A are referred to as trough portions 106 in the present specification. The teeth 104A and the trough portions 106 are an example of the protrusions and recesses of the present invention.

As shown in FIGS. 7 and 8, the large diameter portion 82A of the elastic material winding stem pipe 82 is inserted into the annular space portion between the peripheral wall 94 of the driving crown 56 and the large diameter shaft portion 102 of the shaft member 92. Between the large diameter portion 82A of the elastic material winding stem pipe 82 and the peripheral wall 94 of the driving crown 56, there is provided a space allowing deformation to the outer side in the radial direction of the elastically deformable member 86.

Normally, as shown in FIG. 8, the inner side corner portion at the peripheral end portion of the elastically deformable member 86 of the elastic material winding stem pip2 82 is held inside the trough portion 106 between the teeth 104A of the large diameter shaft portion 102, and the inner peripheral surface of the elastically deformable member 86 is in contact with the apex portion of one tooth 104A, with the inner side corner portion of the elastically deformable member 86 being in contact with the inclined surface of the other tooth 104A.

(Operation and Effect)

In the following, the operation and effect of the wristwatch 10 of the present embodiment will be described.

To rotate the in-revolving ring 20, the driving crown 56 is rotated as in the first embodiment, whereby the in-revolving ring 20 is rotated.

In the present embodiment, when the driving crown 56 is rotated, the elastically deformable member 86 is pressed by a tooth 104A of the shaft member 92, and the elastically deformable member 86 undergoes elastic deformation so as to be inclined outwardly in the radial direction. When the rotation of the driving crown 56 is further continued, the inner side corner portion of the elastically deformable member 86 gets over the apex portion of the tooth 104A, and enters the next trough portion 106 between the tooth 104A gotten over and the other tooth 104A adjacent to the tooth 104A gotten over. When the inner side corner portion of the elastically deformable member 86 enters the next trough portion 106, the elastically deformable member 86 is elastically restored to the former position.

In this way, the driving crown 56 is rotated, and the inner side corner portion of the elastically deformable member 86 gets over the apex portion of the tooth 104A to enter the next trough portion 106, whereby it is possible to experience a tactile feel, and the operator can perceptibly determine that the driving crown 56 is rotating.

On the other hand, normally (i.e., when the crown is not being operated), the inner side corner portion of the elastically deformable member 86 enters the trough portion 106 between the teeth 104A of the shaft member 92 and is held therein as shown in FIG. 8, so that it is possible to suppress inadvertent rotation of the driving crown 56 when, for example, the driving crown 56 comes into contact with some object.

Thus, also in the present embodiment, as in the first embodiment, although the driving wheel 72 is constantly in mesh with the moved cogwheel portion 28 of the in-revolving ring 20, it is possible to suppress inadvertent rotation of the in-revolving ring 20 and idling of the driving crown 56 when, for example, the wristwatch is being carried about.

As described above, the click structure providing a tactile feel can be formed by the two components of the driving crown 56 and the elastic material winding stem pipe 82, so that also in the wristwatch 10 of the present embodiment, it is possible to realize the click mechanism in a simple structure.

Further, the inner side corner portion of the elastically deformable member 86 enters the trough portion 106 between the teeth 104A of the shaft member 92 of the driving crown 56, and is retained therein, so that it is possible to suppress rattling in the rotational direction of the driving crown 56 in a simple structure.

Further, the click mechanism can be assembled by the following simple operation. After the elastic material winding stem pipe 82 is inserted into the through-hole 42, the shaft member 92 of the driving crown 56 is inserted into the elastic material winding stem pipe 82, and then the driving wheel 72 is fixed to the distal end side of the shaft member 92 by the retaining ring 78. Also in the present embodiment, as in the first embodiment, when the shaft member 92 is inserted, there is involved no repulsion due to a spring as in Patent Document 1, so that the incorporating operation is facilitated.

While in the above description the inner side corner portion of the elastically deformable member 86 enters the trough portion 106 between the teeth 104A of the shaft member 92 and the driving crown 56 is retained, it may also be said that the two teeth 104A of the shaft member 92 enter the recessed portion on the inner peripheral surface side of the elastically deformable member 86 bent into a chevron-like shape to retain the driving crown 56.

Third Embodiment

The wristwatch 10 according the third embodiment of the present invention will be described with reference to FIG. 11. The components that are the same as those of the above-described embodiments are indicated by the same reference numerals, and a description thereof will be left out.

Figure 11:
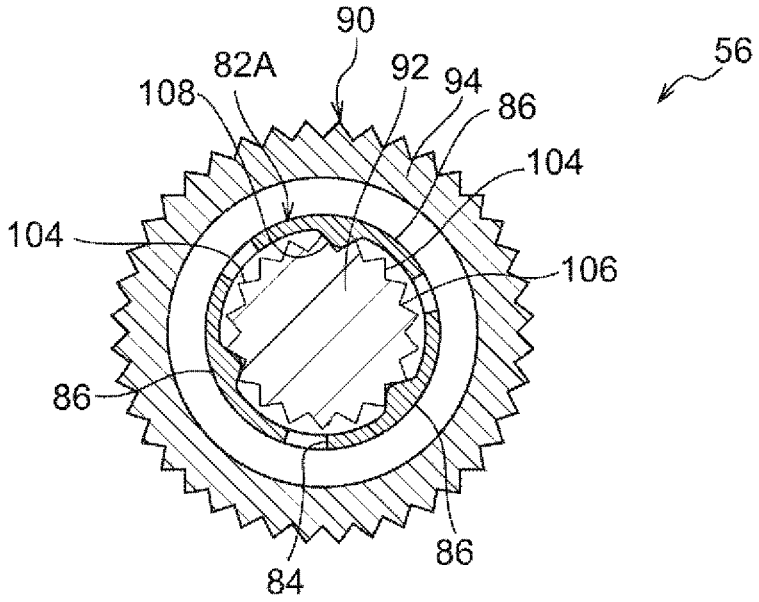
FIG. 11 is a sectional view of a driving crown, a shaft portion, and an elastic material winding stem pipe of a wristwatch according to a third embodiment.

As shown in FIG. 11, the wristwatch 10 of the present embodiment is a modification of the second embodiment, and the configuration of the elastic material winding stem pipe 82 is somewhat different from that of the second embodiment.

The large diameter portion 82A of the elastic material winding stem pipe 82 of the present embodiment is of a cylindrical configuration, and has on the inner peripheral surface thereof a protrusion 108 configured to enter the trough portion 106 between the teeth 104A of the shaft member 92. The operation and effect of the present embodiment is the same as those of the second embodiment.

Other Embodiments

The above description of the embodiment of the present invention should not be construed restrictively. The present invention naturally allows various modifications without departing from the scope of the gist of the invention.

While in the first embodiment the protrusion 80 formed on the inner peripheral surface of the peripheral wall 62 of the driving crown 56 is caused to enter the trough portion 48 between the teeth 46A provided on the outer peripheral portion of the large diameter portion 44A of the elastic material winding stem pipe 44 to thereby form the click mechanism, this should not be construed restrictively. It is also possible for a protrusion formed on the outer peripheral surface of the elastic material winding stem pipe 44 to enter a recess formed in the inner peripheral surface of the peripheral wall 62.

While in the above-described embodiment the in-revolving ring 20 constitutes an example of the mechanism inside the case 12 that is driven through rotation of the driving crown 56, this should not be construed restrictively. Apart from the in-revolving ring 20, the object of driving through rotation of the driving crown 56 may, for example, be a calendar or a movement.

While in the above embodiments the present invention is applied to a wristwatch, this should not be construed restrictively. The present invention is also applicable to a timepiece other than a wristwatch. There are no particular restrictions regarding the configuration and mode of the timepiece so long as it is capable of displaying time. It may also be a portable apparatus or the like which is not usually called a timepiece.

What is claimed is:

1. A timepiece comprising:

a tube member extending along an axial direction and having a through-hole extending along the axial direction, wherein the tube member protrudes out of an outer side of a case, and wherein a distal end portion of the tube member along the axial direction is capable of elastic deformation in a radial direction;

a crown rotatably inserted into the through-hole of the tube member;

protrusions and recesses formed on a peripheral surface of one of the tube member or the crown, wherein the peripheral surface of the one of the tube member or the crown extends along the axial direction of the tube member; and an engagement portion that is formed on a peripheral surface of another of the tube member or the crown and that is engaged with the protrusions and recesses, wherein the peripheral surface of the other of the tube member or the crown also extends along the axial direction of the tube member.

2. The timepiece according to claim 1, wherein a portion of the tube member capable of elastic deformation is formed by a divisional member obtained through peripheral division by a plurality of grooves extending from a distal end side toward a proximal end side of the tube member and formed at peripheral intervals.

3. The timepiece according to claim 2, wherein the divisional member has, on the proximal end side thereof, a thin-walled portion that is thinner than on the distal end side.

4. The timepiece according to claim 1, wherein the crown is equipped with a shaft member inserted in the through-hole of the tube member and a cap-like head portion which is connected to a distal end of the shaft member and the case side of which is open;

a protrusion as the engagement portion is formed on an inner peripheral portion of the head portion, wherein the inner peripheral portion of the head portion extends along the axial direction of the tube member; and the protrusions and recesses are formed on an outer peripheral portion of the tube member, wherein the outer peripheral portion of the tube member extends along the axial direction of the tube member.

5. The timepiece according to claim 1, wherein the crown is equipped with a shaft member inserted in the through-hole of the tube member and a cap-like head portion which is connected to a distal end of the shaft member and the case side of which is open;

the protrusions and recesses are formed on an outer peripheral portion of the shaft member, wherein the outer peripheral portion of the shaft member extends along the axial direction of the tube member; and the engagement portion is formed on an inner peripheral portion of the tube member, wherein the inner peripheral portion of the tube member extends along the axial direction of the tube member.

6. The timepiece according to claim 2, wherein the crown is equipped with a shaft member inserted in the through-hole of the tube member and a cap-like head portion which is connected to a distal end of the shaft member and the case side of which is open;

a protrusion as the engagement portion is formed on an inner peripheral portion of the head portion, wherein the inner peripheral portion of the head portion extends along the axial direction of the tube member; and the protrusions and recesses are formed on an outer peripheral portion of the tube member, wherein the outer peripheral portion of the tube member extends along the axial direction of the tube member.

7. The timepiece according to claim 2, wherein the crown is equipped with a shaft member inserted in the through-hole of the tube member and a cap-like head portion which is connected to a distal end of the shaft member and the case side of which is open;

the protrusions and recesses are formed on an outer peripheral portion of the shaft member, wherein the outer peripheral portion of the shaft member extends along the axial direction of the tube member; and the engagement portion is formed on an inner peripheral portion of the tube member, wherein the inner peripheral portion of the tube member extends along the axial direction of the tube member.

8. The timepiece according to claim 3, wherein the crown is equipped with a shaft member inserted in the through-hole of the tube member and a cap-like head portion which is connected to a distal end of the shaft member and the case side of which is open;

a protrusion as the engagement portion is formed on an inner peripheral portion of the head portion, wherein the inner peripheral portion of the head portion extends along the axial direction of the tube member; and the protrusions and recesses are formed on an outer peripheral portion of the tube member, wherein the outer peripheral portion of the tube member extends along the axial direction of the tube member.

9. The timepiece according to claim 3, wherein the crown is equipped with a shaft member inserted in the through-hole of the tube member and a cap-like head portion which is connected to a distal end of the shaft member and the case side of which is open;

the protrusions and recesses are formed on an outer peripheral portion of the shaft member, wherein the outer peripheral portion of the shaft member extends along the axial direction of the tube member; and the engagement portion is formed on an inner peripheral portion of the tube member, wherein the inner peripheral portion of the tube member extends along the axial direction of the tube member.

* * * * *